US007431167B2

(12) United States Patent
Weaver et al.

(10) Patent No.: US 7,431,167 B2
(45) Date of Patent: Oct. 7, 2008

(54) ADJUSTABLE COUPLER ASSEMBLY FOR MODEL TRAINS

(75) Inventors: James J. Weaver, Dunellen, NJ (US); Gong Shi Ming, Nan Chong Town (CN)

(73) Assignee: Atlas O, LLC, Hillside, NJ (US)

( * ) Notice: Subject to any disclaimer, the term of this patent is extended or adjusted under 35 U.S.C. 154(b) by 373 days.

(21) Appl. No.: 11/280,085

(22) Filed: Nov. 16, 2005

(65) Prior Publication Data

US 2006/0102579 A1 May 18, 2006

Related U.S. Application Data

(60) Provisional application No. 60/628,240, filed on Nov. 16, 2004.

(51) Int. Cl.
*A63H 19/18* (2006.01)
*B61G 1/00* (2006.01)

(52) U.S. Cl. ..... 213/75 TC; 213/75 R

(58) Field of Classification Search ..... 213/75, 213/75 R, 211, 75 TC
See application file for complete search history.

(56) References Cited

U.S. PATENT DOCUMENTS 1,789,042 A * 1/1931 Ives et al. ..... 105/157.2
3,140,783 A * 7/1964 Kretzmer, Jr. et al. ... 213/75 TC
3,518,790 A * 7/1970 Zamarra ..... 105/157.2
3,612,295 A * 10/1971 Glauser ..... 213/15
4,512,483 A * 4/1985 Crossley et al. ..... 213/75 TC
4,547,107 A * 10/1985 Krause ..... 410/58
4,669,391 A * 6/1987 Wicks et al. ..... 105/4.3
4,766,818 A * 8/1988 Wicks et al. ..... 105/4.3
4,907,514 A * 3/1990 Wicks et al. ..... 105/4.3
5,040,466 A * 8/1991 Wicks et al. ..... 105/4.3
5,316,158 A * 5/1994 Dunham et al. ..... 213/75 TC
5,398,619 A * 3/1995 Buccos ..... 105/157.2
5,615,813 A * 4/1997 Ouellette ..... 224/405
5,890,433 A * 4/1999 Wicks ..... 105/4.2
6,189,713 B1 * 2/2001 Oh ..... 213/75 TC
6,393,996 B1 * 5/2002 Duncan et al. ..... 105/4.2
6,502,845 B1 * 1/2003 Van Vleet ..... 280/491.1
6,910,424 B2 * 6/2005 Ruocchio et al. ..... 105/3
D530,380 S * 10/2006 Weaver et al. ..... D21/561
2006/0054582 A1 * 3/2006 Webster et al. ..... 213/75 TC
2006/0102579 A1 * 5/2006 Weaver et al. ..... 213/75 TC
2007/0096428 A1 * 5/2007 Miles et al. ..... 280/490.1

* cited by examiner

*Primary Examiner*—J. Allen Shriver
*Assistant Examiner*—Jason C Smith
(74) *Attorney, Agent, or Firm*—Panitch Schwarze Belisario & Nadel LLP

(57) ABSTRACT

An adjustable coupler assembly for a truck assembly of a model railroad car includes an adjustment arm engaged with the truck assembly. The adjustment arm is selectively movable with respect to the truck assembly in a first direction. A coupler pocket is engaged with the adjustment arm. The coupler pocket is selectively movable with respect to the adjustment arm in a second direction. A coupler is pivotably attached to the coupler pocket. The adjustment arm and the coupler pocket are selectively movable to adjust the coupler in the first and second directions with respect to the truck assembly.

17 Claims, 5 Drawing Sheets

ADJUSTABLE COUPLER ASSEMBLY FOR MODEL TRAINS

CROSS-REFERENCE TO RELATED APPLICATIONS

This patent application claims priority to U.S. Provisional Patent Application No. 60/628,240, filed Nov. 16, 2004, entitled "Adjustable Coupler Assembly for Model Trains", the disclosure of which is incorporated herein by reference.

BACKGROUND OF THE INVENTION

This invention generally relates to couplers for coupling toy vehicles and, more particularly, to an adjustable coupler assembly for use with model railroad cars.

Couplers for model railroad cars are generally known and are used to couple model railroad cars to one another in order to form a train for operation on a model railroad track. With reference to O-scale model trains specifically, there are two varieties of model train sets: two-rail sets and three-rail sets. For two-rail sets, the model railroad cars have couplers that are attached to undersides of the bodies of the cars, typically proximate the fronts and backs thereof. Although functional, having couplers engaged with the bodies instead of trucks of the cars is unrealistic and takes away from the authenticity of the car and the model railroad set. For three-rail sets, although the couplers are typically attached directly to the trucks of the cars, the couplers are very large and are not close to scale, thereby detracting from the realism and authenticity of the car and the model railroad set. Moreover, regardless of whether the set is of the three-rail or two-rail variety and regardless of the scale of the set, the couplers associated therewith are not adjustable in either a vertical, height direction or a horizontal, length direction. Because the couplers are not adjustable, coupler height and spacing between cars cannot be adjusted and can result in unrealistic coupler heights and spacings between coupled cars.

Therefore, it would be desirable to have a coupler assembly that is mounted to the truck of the model railroad car that is close to scale, such that the coupler device has greater realism and authenticity than the generally known couplers. It is further desirable to have a coupler assembly that is adjustable in both a vertical, height direction and a horizontal, length direction to enable the height of the coupler and the spacing between cars to be adjusted in order to add further realism and authenticity.

BRIEF SUMMARY OF THE INVENTION

Briefly stated, the present invention is an adjustable coupler assembly for a truck assembly of a model railroad car. The adjustable coupler assembly comprises an adjustment arm engaged with the truck assembly. The adjustment arm is selectively movable with respect to the truck assembly in a first direction. A coupler pocket is engaged with the adjustment arm. The coupler pocket is selectively movable with respect to the adjustment arm in a second direction. A coupler is pivotably attached to the coupler pocket. The adjustment arm and the coupler pocket are selectively movable to adjust the coupler in the first and second directions with respect to the truck assembly.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
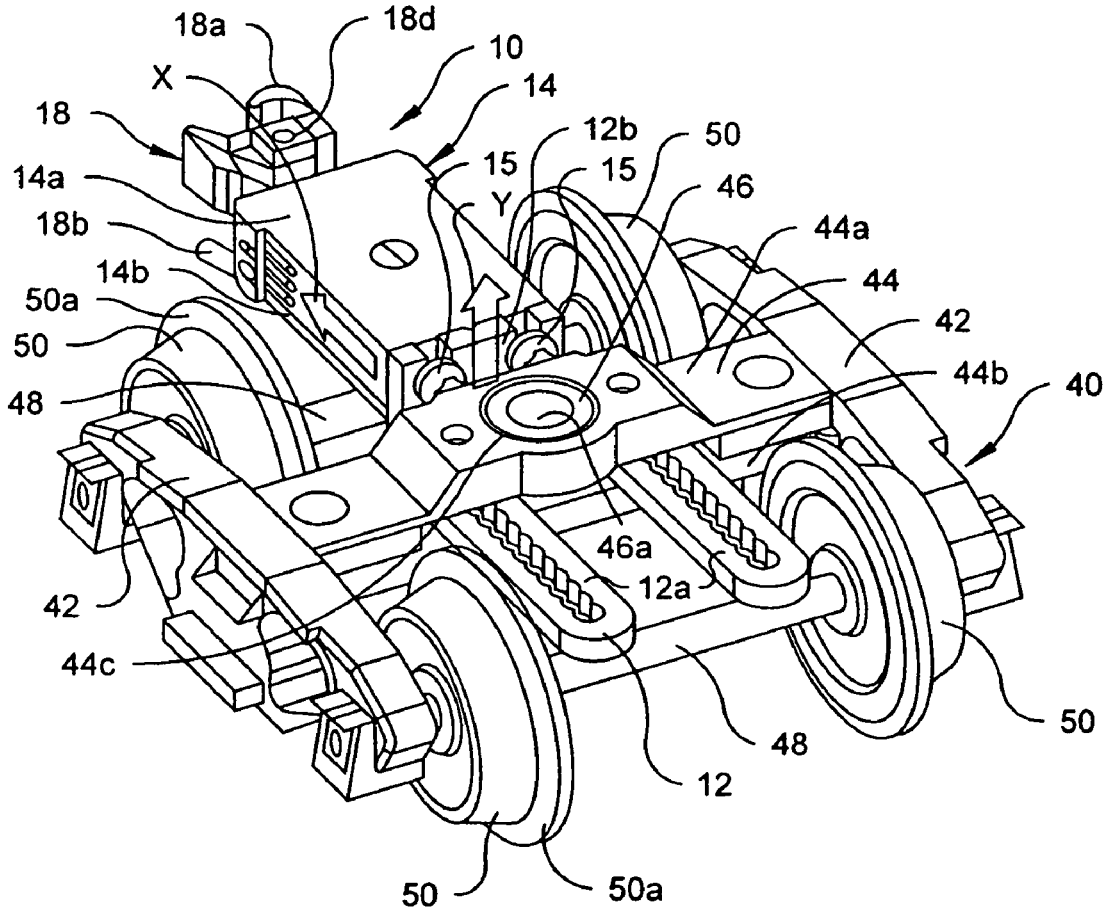
FIG. 1 is a top perspective view of an adjustable coupler assembly and truck assembly for a model railroad car in accordance with a preferred embodiment of the present invention.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

Referring to the drawings in detail, wherein like numerals indicate like elements throughout, there is shown in FIGS. 1-9 a preferred embodiment of an adjustable coupler assembly, indicated generally at 10, in accordance with the present invention. The coupler assembly 10 is intended to be used with a truck assembly 40 of a model railroad car 80.

Referring to FIG. 1, the truck assembly 40 includes two side frames 42, generally parallel to and spaced from each other. A bolster 44 is engaged with and preferably extends between centers of the side frames 42 to rigidly couple the side frames 42. The bolster 44 is preferably generally perpendicular to the side frames 42, such that the side frames 42 and bolster 44 are generally H-shaped in plan view. The bolster 44 generally includes a top bar 44*a* and a bottom bar 44*b*, with a slight space between the top bar 44*a* and the bottom bar 44*b*. A bushing 46 extends from a top of the bottom bar 44*b*, preferably extending at least partially through a hole 44*c* through the top bar 44*a*. The bushing 46 preferably has a bushing hole 46*a* therethrough. Axles 48 extend between the side frames 42. Preferably, there are two axles 48 with one axle 48 extending between proximate front ends of the side frames 42 and the other axle 48 extending between proximate back ends of the side frames 42, such that the axles 48 are disposed on opposite sides of the bolster 44. Although this is preferred, it is within the spirit and scope of the present invention that the axles 48 be disposed in different locations along the side frames 42 or that there be more or less than two axles 48 associated with the truck assembly 40. Preferably, the axles 48 are rotatable with respect to the side frames 42.

Engaged with each axle 48 are wheels 50. The wheels 50 are preferably fixed with respect to the axles 48 so as to rotate therewith relative to the side frames 42. Preferably, there are two wheels 50 engaged with each axle 48 proximate each end thereof, such that the wheels 50 are disposed proximate the side frames 42 in an assembled truck assembly 40. Although this is preferred, it is within the spirit and scope of the present invention that the wheels 50 be located at any point along the axles 48 or that there be more or less than two wheels 50 on each axle 48 so long as the wheels 50 are able to function as described herein.

Figure 9:
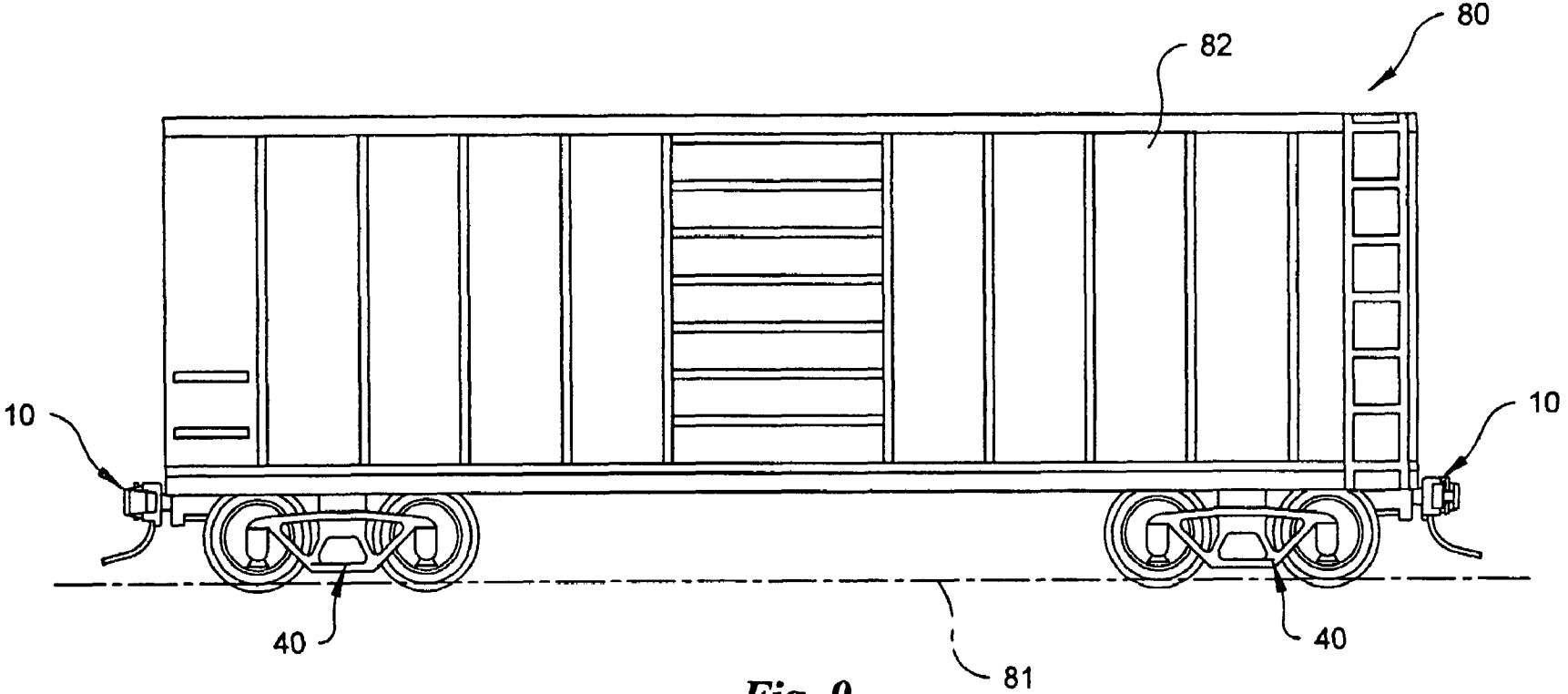
FIG. 9 is a side elevational view of a model railroad car having the truck assemblies with adjustable coupler assemblies of FIG. 1.

Referring now to FIGS. 1 and 9, the wheels 50 are appropriately spaced along the axles 48 so that the truck assembly 40 fits on and rolls along a model railroad track 81 (schematically depicted in phantom in FIG. 9) of the desired scale. Each wheel 50 preferably has a generally circular flange 50*a* extending radially therefrom on the inboard side thereof to help retain the wheels 50 of the truck assembly 40 on the track 81. That is, when the truck assembly 40 is properly mounted on the track 81, portions of the wheels 50 roll along tops of track rails with the flanges 50*a* disposed on an inside of each track rail. The flanges 50*a* maintain the railroad car 80 on the track 81 and act to reduce excessive side-to-side movement of the wheels 50 with respect to the track 81 during rolling motion of the truck assembly 40 along the track 81, thereby decreasing the chance of derailment of the truck assembly 40.

Preferably, the truck assembly 40 is rotatably attached to a bottom of a body 82 of the model railroad car 80 using a rivet (not shown), screw (not shown), or other such fastener (not shown) extending through the bushing hole 46*a* and into a hole (hidden) in the bottom of the car 80, such that the truck assembly 40 is at least pivotable about the fastener with respect to the car 80.

Figure 2:
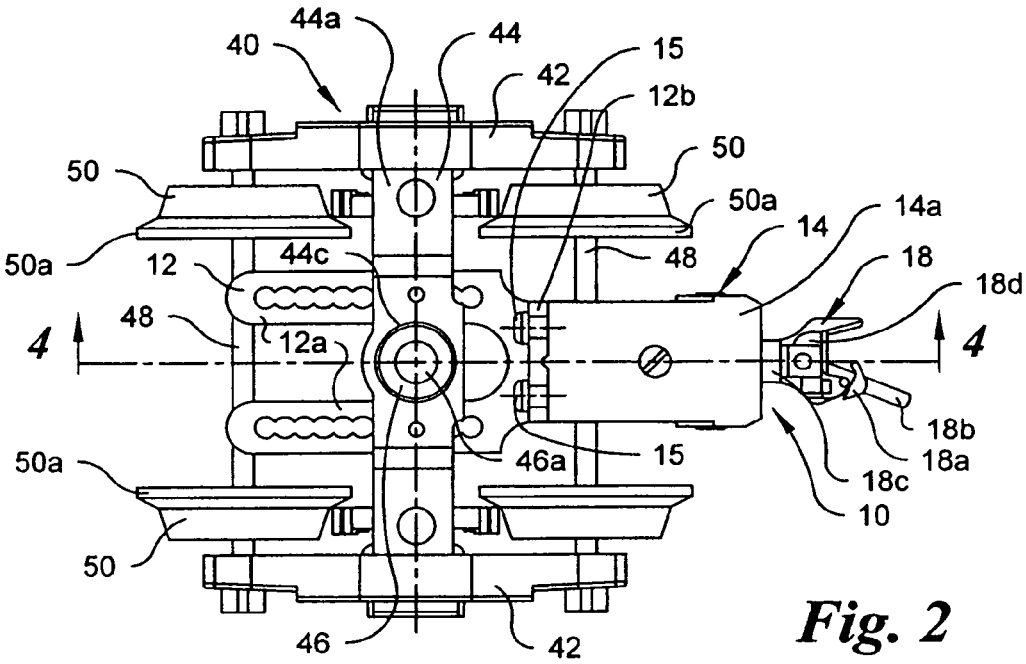
FIG. 2 is a top plan view of the adjustable coupler assembly and truck assembly of FIG. 1.
Figure 3:
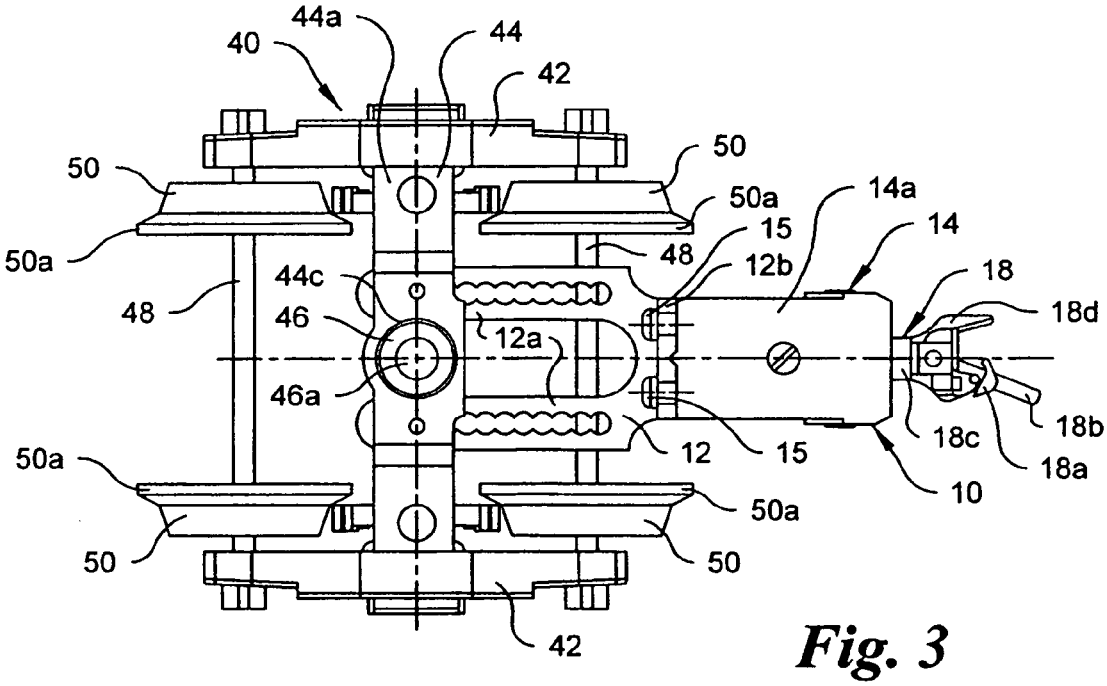
FIG. 3 is a top plan view of the adjustable coupler assembly and the truck assembly of FIG. 1, the adjustable coupler assembly being in an extended position.

Referring to FIGS. 1-3, the coupler assembly 10 includes a generally U-shaped adjustment arm 12, a coupler pocket 14 attached to the adjustment arm 12, and a coupler 18 at least pivotably attached within the coupler pocket 14. The coupler assembly 10 is engaged with the above-described truck assembly 40 to be adjustable with respect thereto, as is discussed below.

Referring to FIGS. 1-3, 5, and 6, the adjustment arm 12 is preferably engaged directly with the truck assembly 40. The adjustment arm 12 is preferably selectively movable with respect to the truck assembly 40 in a first direction X. Preferably, movement of the adjustment arm 12 in the first direction X with respect to the truck assembly 40 adjusts the coupler 18 in a generally horizontal direction with respect to the truck assembly 40. Preferably, the adjustment arm 12 includes at least one first slot 12*c* along which the adjustment arm 12 is selectively movable with respect to the truck assembly 40 in the first direction X. The truck assembly 40 preferably includes at least one first fastener 13, which is selectively engageable within the at least one first slot 12*c* to fix the adjustment arm 12 with respect to the truck assembly 40. A tab 12*b* preferably extends generally outwardly or upwardly from the adjustment arm 12 and generally perpendicularly to the horizontal arms 12*a*, such that the adjustment arm 12 is generally L-shaped when viewed from the side.

The adjustment arm 12 preferably has two generally parallel spaced horizontal arms 12*a* extending outwardly therefrom. It is preferred that the horizontal arms 12*a* each have a first slot 12*c* extending therethrough and disposed generally along the entire length of the horizontal arms 12*a*. The first slots 12*c* are generally made up of a plurality of conjoined, aligned circular holes, such that the sides of the first slots 12*c* essentially have a generally saw-toothed shape.

Referring to FIGS. 1-3, 7, and 8, the coupler pocket 14 is preferably engaged with the adjustment arm 12 and includes a generally box-shaped base 14*a* having an open bottom and an opening 14*c* in a side thereof. A generally rectangular cover 14*b* engages with the bottom of the base 14*a* to close the opening thereof. A pivot pin 14*d*, generally in the form of a cylindrical, tubular protrusion, extends downwardly from an inside of a top of the base 14*a*, such that the pivot pin 14*d* is disposed within the base 14*a* with an end of the pivot pin 14*d* being proximate to, and preferably abutting, an inside surface of the cover 14*b* when the cover 14*b* is attached to the base 14*a*. A generally V-shaped alignment ridge 14*e* extends outwardly from a side of the base 14*a* opposite the opening 14*c*. The alignment ridge 14*e* extends from the top to the bottom of the base 14*a*.

Referring again to FIGS. 1-3 and 6, the coupler pocket 14 is preferably selectively movable with respect to the adjustment arm 12 in a second direction Y. The adjustment arm 12 preferably includes at least one second slot 12*d* along which the coupler pocket 14 is selectively moved with respect to the adjustment arm 12 in the second direction Y. The coupler pocket 14 preferably includes at least one second fastener 15, which is selectively engageable within the at least one second slot 12*d* to fix the coupler pocket 14 with respect to the adjustment arm 12.

More specifically, it is preferred that the tab 12*b* have two generally parallel, spaced apart second slots 12*d* extending therethrough from a top of the tab 12*b* downwardly to a point proximate a bottom of the tab 12*b*. A generally V-shaped alignment notch 12*e* is preferably disposed in an outer face of the tab 12*b*, extending from the bottom of the tab 12*b* to the top of the tab 12*b* between the second slots 12*d*. While the above-described configuration of the adjustment arm 12 is preferred, it is within the spirit and scope of the present invention that the adjustment arm 12 be configured differently, provided it is capable of functioning as described herein.

Referring to FIGS. 1-4, it is preferred that the coupler 18 is movably disposed at least partially within the coupler pocket 14. The coupler 18 is preferably pivotably attached to the coupler pocket 14, such that selective movement of the adjustment arm 12 and the coupler pocket 14 adjusts the coupler 18 in the first and second directions X, Y with respect to the truck assembly 40. Preferably, selective movement of the coupler pocket 14 in the second direction Y with respect to the adjustment arm 12 adjusts the coupler 18 in a generally vertical direction with respect to the truck assembly 40.

The coupler 18 includes a coupler portion 18*d* having a knuckle 18*a* pivotably attached thereto. The knuckle 18*a* is preferably spring biased to a closed position to enable the coupler 18 to interlock with another similar coupler 18. This is accomplished by driving one coupler 18 into the other, the other coupler 18 being oppositely disposed, such that the knuckle 18*a* thereof is oriented oppositely from the knuckle 18*a* of the first coupler 18. The shape of the knuckles 18*a* allows each of the knuckles 18*a* to pivot to an open position, allowing the knuckles 18*a* to slip by one another, such that the knuckle 18*a* of each coupler 18 is disposed within the coupler portion 18*d* of the other coupler 18. Once the knuckles 18*a* have cleared each other, the knuckles 18*a* are free to move back into the closed position, thereby interlocking the coupler portions 18*d* of the couplers 18. Knuckle couplers of this type are generally well-known in the art and, therefore, further description thereof is omitted for convenience purposes only and is not limiting.

Preferably extending downwardly from the coupler 18 is a bar 18*b*, which is rotatably coupled with the knuckle 18*a* to allow a user to open and close the knuckle 18*a* by manipulating the bar 18*b*. The bar 18*b* is preferably bent in a way to protrude away from the coupler 18 so as to allow the user relatively easy access thereto. An elongate coupler arm 18*c* extends rearwardly from the coupler portion 18*d*. The coupler arm 18*c* preferably has a coupler hole 18*e* therethrough extending from a top to a bottom of the coupler arm 18*c* at a location spaced from the coupler portion 18*d*. As will be described in more detail below, when assembled, the pivot pin 14*d* is disposed within the coupler hole 18*e* to enable the coupler 18 to generally pivot about the pivot pin 14*d*. Preferably, the coupler hole 18*e* is generally slot-like to further allow the coupler 18 to slide with respect thereto in addition to pivoting. While this configuration of the coupler hole 18*e* is preferred, it is not intended to be limiting. As such, it is within the spirit and scope of the present invention for the coupler hole 18*e* to be configured in a different manner or for the coupler 18 to be pivotable in a different manner, provided the coupler 18 is still capable of functioning as described herein.

Referring to FIGS. 2-4 and 6-8, the coupler pocket 14 is preferably fastened to the tab 12*b* of the adjustment arm 12 with two second fasteners 15, one second fastener 15 extending through each of the second slots 12*d* and engaging within a hole (unnumbered) in the side of the coupler pocket 14 opposite the opening 14*c*. Preferably the second fasteners 15 are screws, although it is within the spirit and scope of the present invention that the second fasteners 15 be any type of fastener capable of performing in the manner described herein. The alignment ridge 14*e* preferably fits and is disposed within the alignment notch 12*e* when the coupler pocket 14 is engaged with the adjustment arm 12. The coupler 18 is pivotably engaged within the coupler pocket 14 so that the coupler 18 extends outwardly from the opening 14*c* of the coupler pocket 14 to expose at least the coupler portion 18*d* of the coupler 18.

Figure 4:
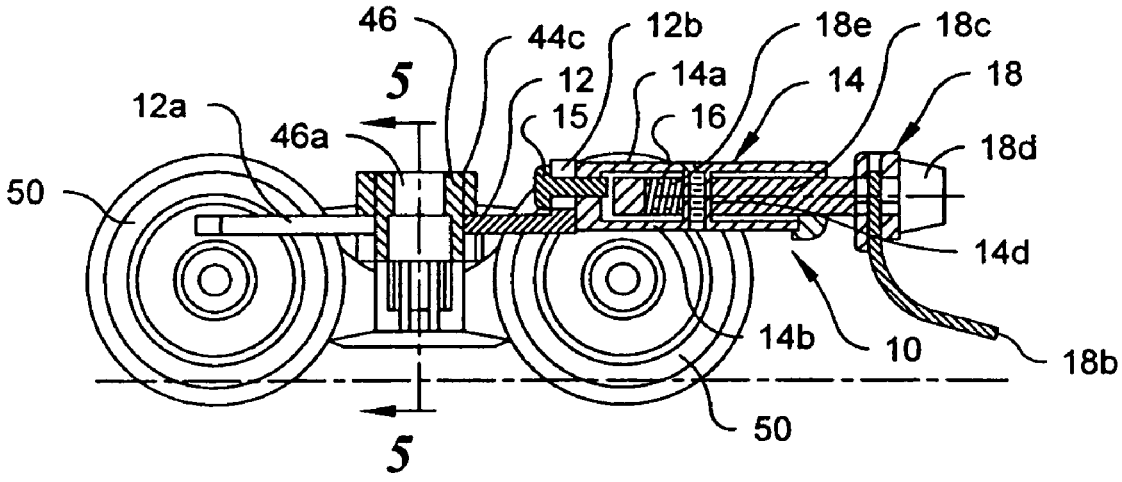
FIG. 4 is a cross-sectional side elevational view of the adjustable coupler assembly and the truck assembly of FIG. 2 taken along line 4-4.
Figure 5:
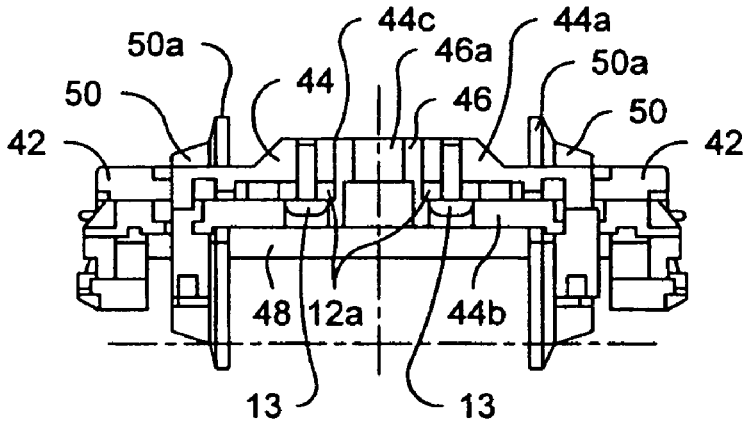
FIG. 5 is a cross-sectional elevational view of the adjustable coupler assembly and the truck assembly of FIG. 4 taken along line 5-5.
Figure 6:
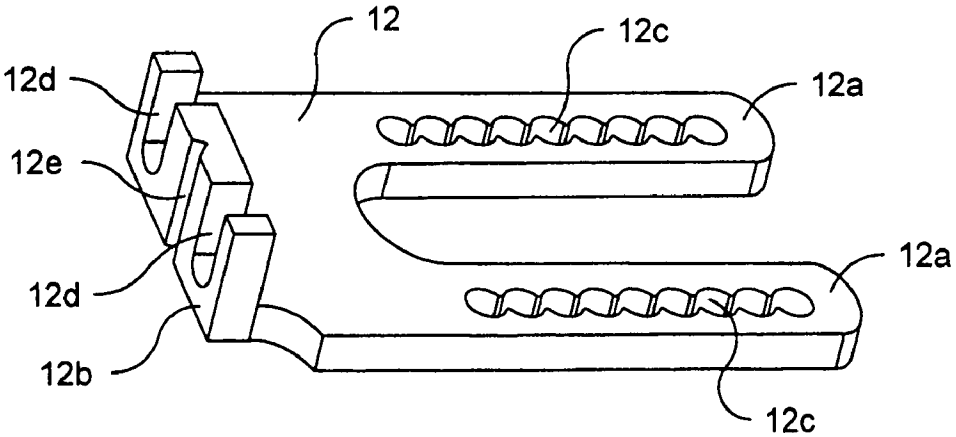
FIG. 6 is a top perspective view of an adjustment arm of the adjustable coupler assembly of FIG. 1.
Figure 8:
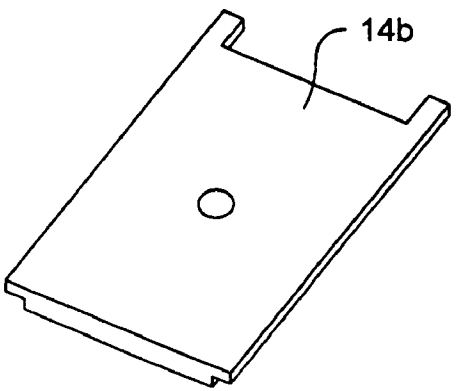
FIG. 8 is a bottom perspective view of a cover for the coupler pocket of FIG. 7.
Figure 7:
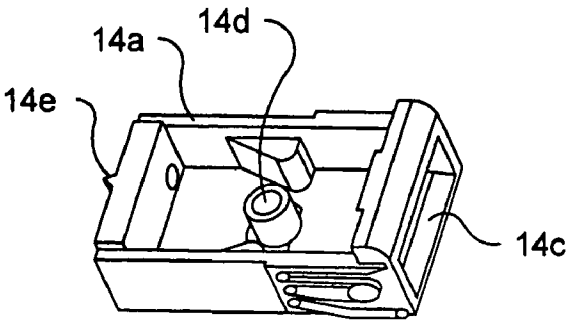
FIG. 7 is a bottom perspective view of a coupler pocket of the adjustable coupler assembly of FIG. 1.

Referring specifically to FIG. 4, when assembled, the pivot pin 14*d* is disposed within the coupler hole 18*e* to allow the coupler 18 to pivot about the pivot pin 14*d* of the coupler pocket 14, thereby pivotably engaging the coupler 18 within the coupler pocket 14. As stated above, preferably, the coupler hole 18*e* is in the form of an elongate slot and is proximate the end of the coupler arm 18*c* opposite the coupler portion 18*d*. A spring 16 is preferably disposed between a proximal end of the slot-like coupler hole 18*e* and the pivot pin 14*d* disposed within the coupler hole 18*e*. The spring 16 acts to force the coupler 18 inwardly with respect to the coupler pocket 14 so that the pivot pin 14*d* abuts a distal end of the slot-like coupler hole 18*e*, thereby biasing the coupler 18 inwardly with respect to the coupler pocket 14. Having the spring 16 disposed within the coupler hole 18*e* in this way allows the coupler 18 to extend outwardly from the coupler pocket 14 slightly when pulled. In this way, the coupler 18 is configured to "give" slightly when pulled making connections between couplers 18 of coupled railroad cars 80 less rigid and less likely to separate around turns and/or during acceleration.

Referring to FIGS. 1-5, the coupler assembly 10 is preferably engaged with the truck assembly 40 by sliding the horizontal arms 12*a* of the adjustment arm 12 between the top and bottom bars 44*a*, 44*b* of the bolster 44 and fastening the adjustment arm 12 to the bolster 44 using two first fasteners 13, with one first fastener 13 disposed within each first slot 12*c*. Preferably the first fasteners 13 are screws, although it is within the spirit and scope of the present invention that the first fasteners 13 be any type of fastener capable of performing in the manner described herein. Preferably, the first fasteners 13 extend through holes (unnumbered) in the bottom bar 44*b*, through selected holes of the first slots 12*c* of the adjustment arm 12, and into tapped holes (unnumbered) in the top bar 44*a*. Although this method of attaching the coupler assembly 10 to the truck assembly 40 is preferred, it is within the spirit and scope of the present invention that another method could be used provided the coupler assembly 10 and truck assembly 40 can still function as described herein.

In use, the adjustable coupler assembly 10 can be used with the truck assembly 40 by obtaining a truck assembly 40 already having holes through the bolster 44 or, alternatively, by retrofitting an existing truck assembly 40 to accommodate the coupler assembly 10 by drilling holes through the top and bottom bars 44*a*, 44*b* and tapping the holes through the top bar 44*a*. The length of the adjustable coupler assembly 10 can be adjusted by placing the first fasteners 13 through different portions of the holes of the first slots 12*c*. That is, the adjustment arm 12 can be placed in a shortened position (FIG. 2) by placing the first fasteners 13 through portions of the first slots 12*c* proximate the tab 12*b*, in an extended position (FIG. 3) by placing the first fasteners 13 through portions of the first slots 12*c* proximate the ends of the horizontal arms 12*a*, or anywhere therebetween. When the first fasteners 13 are disposed through the first slots 12*c*, the generally saw-toothed sides of the first slots 12*c* engage with threaded portions of the first fasteners 13 to prevent horizontal sliding movement of the adjustment arm 12 with respect to the bolster 44, even if the first fasteners 13 are only loosely engaged with the bolster 44. Additionally, the height of the coupler pocket 14 and coupler 18 can be adjusted by slightly loosening the second fasteners 15 attaching the coupler pocket 14 with the adjustment arm 12 and sliding the coupler pocket 14 vertically up or down with respect to the adjustment arm 12 so that the second fasteners 15 slide within the second slots 12*d*. Once the appropriate height of the coupler pocket 14 is achieved, the second fasteners 15 can be tightened to engage the coupler pocket 14 with the adjustment arm 12.

In this way, the adjustable coupler assembly 10 provides a coupler pocket 14 and coupler 18 that are mounted to the truck assembly 40, thereby adding to the realism and authenticity of the coupler assembly 10 of the present invention and improving upon the generally-known body-mounted two-rail O-scale couplers. Also, because the coupler assembly 10 includes a coupler 18 within a coupler pocket 14, the structure of the coupler assembly 10 is more realistic and can be made closer to scale than the generally-known three-rail O-scale couplers, which are typically oversized couplers mounted directly to the trucks without coupler pockets. Furthermore, because the coupler assembly 10 is adjustable in both a vertical, height direction and a horizontal, length direction, the user is able to adjust both the height of the coupler 18 and the coupler pocket 14 as well as the horizontal spacing between model railroad cars in order to obtain a more realistic and authentic look of the model railroad cars 80 when coupled.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention.

We claim:

1. An adjustable coupler assembly for a truck assembly of a model railroad car, the coupler assembly comprising:

an adjustment arm engaged with the truck assembly, the adjustment arm being selectively movable with respect to the truck assembly in a first direction;

a coupler pocket engaged with the adjustment arm, the coupler pocket being selectively movable with respect to the adjustment arm and the truck assembly in a second direction; and a coupler pivotably attached to the coupler pocket, wherein the adjustment arm and the coupler pocket are selectively movable to adjust the coupler in the first and second directions with respect to the truck assembly.

2. The adjustable coupler assembly of claim 1, wherein selective movement of the adjustment arm in the first direction with respect to the truck assembly adjusts the coupler in a generally horizontal direction with respect to the truck assembly.

3. The adjustable coupler assembly of claim 2, wherein selective movement of the coupler pocket in the second direction with respect to the adjustment arm adjusts the coupler in a generally vertical direction with respect to the adjustment arm and the truck assembly.

4. The adjustable coupler assembly of claim 1, wherein selective movement of the coupler pocket in the second direction with respect to the adjustment arm adjusts the coupler in a generally vertical direction with respect to the adjustment arm and the truck assembly.

5. The adjustable coupler assembly of claim 1, wherein the coupler is movably disposed at least partially within the coupler pocket.

6. The adjustable coupler assembly of claim 1, wherein the adjustment arm includes at least one first slot along which the adjustment arm is selectively moved with respect to the truck assembly in the first direction.

7. The adjustable coupler assembly of claim 6, wherein the truck assembly includes at least one first fastener, the at least one first fastener being selectively engageable within the at least one first slot to fix the adjustment arm with respect to the truck assembly.

8. An adjustable coupler assembly for a truck assembly of a model railroad car, the coupler assembly comprising:

an adjustment arm engaged with the truck assembly, the adjustment arm being selectively movable with respect to the truck assembly in a first direction, the adjustment arm including at least one first slot along which the adjustment arm is selectively moved with respect to the truck assembly in the first direction and at least one first fastener being selectively engageable within the at least one first slot to fix the adjustment arm with respect to the truck assembly;

a coupler pocket engaged with the adjustment arm, the adjustment arm including at least one second slot along which the coupler pocket selectively moves with respect to the adjustment arm in a second direction; and a coupler pivotably attached to the coupler pocket, wherein the adjustment arm and the coupler pocket are selectively movable to adjust the coupler in the first and second directions with respect to the truck assembly.

9. The adjustable coupler assembly of claim 8, wherein the coupler pocket includes at least one second fastener, the at least one second fastener being selectively engageable within the at least one second slot to fix the coupler pocket with respect to the adjustment arm.

10. An adjustable coupler assembly for a truck assembly of a model railroad car, the coupler assembly comprising:

an adjustment arm engaged with the truck assembly, the adjustment arm being selectively movable with respect to the truck assembly in a first direction;

a coupler pocket engaged with the adjustment arm, the coupler pocket being selectively movable with respect to the adjustment arm and the truck assembly in a second direction, the adjustment arm including at least one second slot along which the coupler pocket is selectively moved with respect to the adjustment arm in the second direction; and a coupler pivotably attached to the coupler pocket, wherein the adjustment arm and the coupler pocket are selectively movable to adjust the coupler in the first and second directions with respect to the truck assembly.

11. The adjustable coupler assembly of claim 10, wherein the coupler pocket includes at least one second fastener, the at least one second fastener being selectively engageable within the at least one second slot to fix the coupler pocket with respect to the adjustment arm.

12. The adjustable coupler assembly of claim 1, wherein the first direction is generally perpendicular to the second direction.

13. The adjustable coupler assembly of claim 1, wherein the adjustment arm is removably mounted to the truck assembly in a plurality of positions along the first direction and coupler pocket is removably mounted to the adjustment arm in a plurality of positions along the second direction.

14. The adjustable coupler assembly of claim 13, wherein the plurality of positions along the first direction are spaced at predetermined intervals.

15. The adjustable coupler assembly of claim 13, wherein the adjustment arm is removably mounted to the truck assembly by at least two fasteners.

16. The adjustable coupler assembly of claim 15, wherein the coupler pocket is removably mounted to the adjustment arm by at least two fasteners.

17. The adjustable coupler assembly of claim 1, wherein the coupler pocket extends between and separates the coupler pocket and the coupler.

* * * * *